US008991979B2

(12) United States Patent
Hagiwara et al.

(10) Patent No.: US 8,991,979 B2
(45) Date of Patent: Mar. 31, 2015

(54) LIQUID EJECTING HEAD MODULE AND LIQUID EJECTING APPARATUS

(71) Applicant: Seiko Epson Corporation, Tokyo (JP)

(72) Inventors: Hiroyuki Hagiwara, Matsumoto (JP); Hiroshige Owaki, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/223,976

(22) Filed: Mar. 24, 2014

(65) Prior Publication Data

US 2014/0292938 A1 Oct. 2, 2014

(30) Foreign Application Priority Data

Mar. 27, 2013 (JP) ..... 2013-065815

(51) Int. Cl.

| | |
|---|---|
| ***B41J 2/14*** | (2006.01) |
| ***B41J 2/04*** | (2006.01) |
| ***B41J 2/05*** | (2006.01) |
| ***B41J 2/155*** | (2006.01) |

(52) U.S. Cl.

CPC ..... *B41J 2/155* (2013.01); *B41J 2002/14491* (2013.01); *B41J 2202/20* (2013.01)

USPC ..... 347/50; 347/54; 347/58

(58) Field of Classification Search

None

See application file for complete search history.

(56) References Cited

U.S. PATENT DOCUMENTS

2005/0212858 A1* 9/2005 Imai ..... 347/59
2012/0127242 A1 5/2012 Koike et al.

FOREIGN PATENT DOCUMENTS

JP 2012-111044 A 6/2012

* cited by examiner

*Primary Examiner* — Geoffrey Mruk

(74) *Attorney, Agent, or Firm* — Kilpatrick Townsend & Stockton LLP

(57) ABSTRACT

A unit head has a head main body having a nozzle surface, and a substrate case having a fastening surface fastened to a fixation frame of a frame and accommodating a relay substrate. The fastening surface of a substrate case is formed at a position closer to a surface of an opposite side to a fixation frame than a side surface of a fastening surface side of the head main body, and the head main body is positioned further at an ink ejecting side than the fixation frame with the faster surface being fixed to the fixation frame, the other end of a first cable whose one end is connected to the electrode terminal of a piezoelectric element is connected to the relay substrate, a second cable connected to the relay substrate is drawn to an opposite side to a nozzle surface from a position close to a surface of an opposite side to the fastening surface, and the other end of the second cable is connected to a drive substrate.

8 Claims, 5 Drawing Sheets

LIQUID EJECTING HEAD MODULE AND LIQUID EJECTING APPARATUS

This application claims priority to Japanese Patent Application No. 2013-065815, filed Mar. 27, 2013, the entirety of which is incorporated by reference herein.

BACKGROUND

1. Technical Field

The present invention relates to a liquid ejecting head module and a liquid ejecting apparatus having the same, more particularly to a liquid ejecting head module which is configured to include a plurality of unit heads and a drive substrate in a fixation member, and a liquid ejecting apparatus.

2. Related Art

The liquid ejecting apparatus is an apparatus which includes a liquid ejecting head and ejects various types of liquids from the liquid ejecting head. As the liquid ejecting apparatus, there are image recording apparatuses such as an ink jet printer, an ink jet plotter, and the like. However, recently considering the features of the liquid ejecting apparatus which can accurately shoot a very small amount of liquid on a predetermined position, the liquid ejecting apparatus have been applied to various types of manufacturing apparatuses, such as a display manufacturing apparatus which manufactures a color filter for a liquid crystal display and the like, an electrode forming apparatus which forms an electrode for an organic Electro Luminescence (EL) display, a Field Emission Display (FED), and the like, and a chip manufacturing apparatus which manufactures a biochip (biological and chemical element). A recording head of the image recording apparatus ejects a liquid ink, and a color material ejecting head of the display manufacturing apparatus ejects a solution of each color material of Red (R), Green (G), and Blue (B). In addition, an electrode material ejecting head of the electrode forming apparatus ejects a liquid electrode material, and a bio-organic substance ejecting head of the chip manufacturing apparatus ejects a solution made from bio-organic substance.

Lately, the printer is proposed where a plurality of ink jet recording heads (hereinafter, simply referred to simply as "recording head") which are a type of the liquid ejecting head are fixed to a metal frame (fixation member) as a unit head to be modularized (unitized) (for an example, refer to JP-A-2012-111044). In this type of head module, a drive substrate handles a signal to drive the actuator (pressure generator) of each unit head, and a flow path member to which an ink to be supplied to each unit head is introduced are shared by each unit head, and thus, reducing the size of the entire module can be achieved.

However, recently, there has been a demand for further size reduction, and more particularly for further size reduction of a head module configured to have a unit head fixed to both side surfaces of a metal frame, respectively, the width direction of the head module needs to be more suppressed without lowering the rigidity of the metal frame.

SUMMARY

An advantage of some aspects of the invention is to provide a liquid ejecting head module which can be made small in size and a liquid ejecting apparatus including the liquid ejecting head module.

According to an aspect of the invention, there is provided a unit head having a nozzle surface where a nozzle for ejecting a liquid is formed, a liquid flow path communicating with the nozzle, and a pressure generator creating a change in the liquid pressure in the liquid flow path, and which ejects the liquid in the liquid flow path from the nozzle by driving the pressure generator; a fixation member in which the unit head is fixed to one fixation surface and the other fixation surface, respectively; a drive substrate which is located on a side of the fixation member opposite to the nozzle surface side of each unit head; and a wiring member which electrically connects the pressure generator of the unit head and the drive substrate, and in which the unit head has a first portion having the nozzle surface, and a second portion which is positioned on the opposite side to the nozzle surface of the first portion, has a contact portion which is fastened to the fixation member, and accommodates a portion of the wiring member, the contact portion of the second portion is formed at a position closer to a surface of an opposite side to a fixation member side than the side surface of the fixation portion on the fixation member side, the first portion is positioned further on a liquid ejecting side than the fixation member with the contact portion of the second portion fixed to the fixation member, and the wiring member whose one end portion is connected to the pressure generator is drawn through the second member, from a position close to a surface of an opposite side to the contact portion of the second member at an opposite side to the nozzle surface, and the other end portion of the wiring member is connected to the drive substrate.

In this configuration, the unit head has a first portion which has a nozzle surface, and a second portion which is positioned on an opposite side to the nozzle surface of the first portion, has a contact portion which is fastened to the fixation member, and accommodates a portion of the wiring member. The contact portion of the second portion is formed at the position closer to the surface of the opposite side to the fixation member side than a side surface of the first portion on the contact portion side, and the first portion is positioned further on a liquid ejecting side than the fixation member with the contact portion of the second portion fixed to the fixation member, so that the first portion is disposed closer to the fixation member side (a surface side opposite to a surface to which the unit head is fixed) than the contact portion in the fixed state. Therefore, nozzles of the unit heads fixed to the fixation surface on both sides of the fixation member come close to each other. By this configuration, without changing the thickness of the fixation member and the size of the first portion of the unit head, it is possible to suppress the size of the entire head module in the thickness direction (a contact direction of the contact portion of the unit head with the fixation surface of the fixation member). Therefore, the head module can be made smaller without reducing the rigidity of the fixation member. Then, by securing the rigidity of the fixation member, a position accuracy of each unit head fixed to the fixation member is prevented from being lowered.

In addition, a wiring member whose one end portion is connected to the pressure generator is drawn through the second member, from a position close to a surface of the opposite side to a contact portion of the second member to an opposite side to a nozzle surface, and the other end portion of the wiring member is connected to the drive substrate. Thus, routing the wiring member from a fixed position on the fixation member of the unit head to the drive substrate positioned at an opposite side (an opposite side to the nozzle surface) of the fixation position of the fixation member becomes easy, and the efficiency of the wiring operation is improved. In addition, it is possible to shorten the entire length of the wiring member as much as the length of the possible reduction in the folding, and this can contribute to cost reduction.

In addition, in the configuration, it is desirable to adopt a configuration in which the wiring member includes a first wiring member whose one end side is connected to the pressure generator, a second wiring member whose the other end side is connected to the drive substrate, and a relay substrate relaying between the second wiring member and the first wiring member, the relay substrate has a substrate terminal portion to which the other end side of the first wiring member is connected and a connection portion to which one end side of the second wiring member is connected, and is accommodated in the second portion, and at least the connection portion is disposed on a side of the relay substrate opposite to a fixation side with respect to the fixation member.

In this configuration, the first wiring member, the relay substrate, and the second wiring member are located so as to get close to a surface of the opposite side to the contact portion of the second portion by stages in this order. Therefore, it is possible to draw a wiring member to an opposite side to a nozzle surface from a position close to a surface of an opposite side to the contact portion of the second member without forcedly bending the wiring member from a joining position to the pressure generator.

Furthermore, the liquid ejecting apparatus of the invention includes a liquid ejecting head module in any of the above configurations.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments for carrying out the invention will be described referring to accompanying drawings. The embodiments to be described below are variously limited as an appropriate detailed example of the invention, but the scope of the invention is not limited to these embodiments particularly unless there is a description to the effect of limiting the invention in the following description. In addition, in the following description, as a liquid ejecting apparatus of the invention, an ink jet printer (hereinafter, referred to as "printer") which is mounted with a head module (liquid ejecting head module) 2 to which a plurality of ink jet recording heads (hereinafter, referred to as "unit head") which are a type of a liquid ejecting head are fixed is used as an example.

Figure 1A:
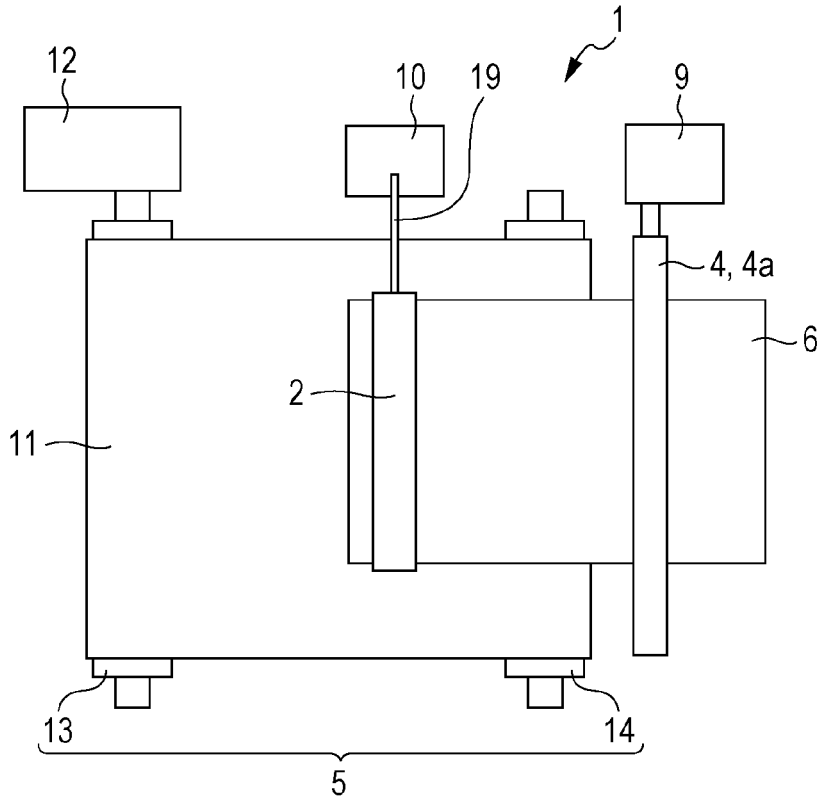
FIGS. 1A and 1B are schematic views each describing an internal configuration of a printer.
Figure 1B:
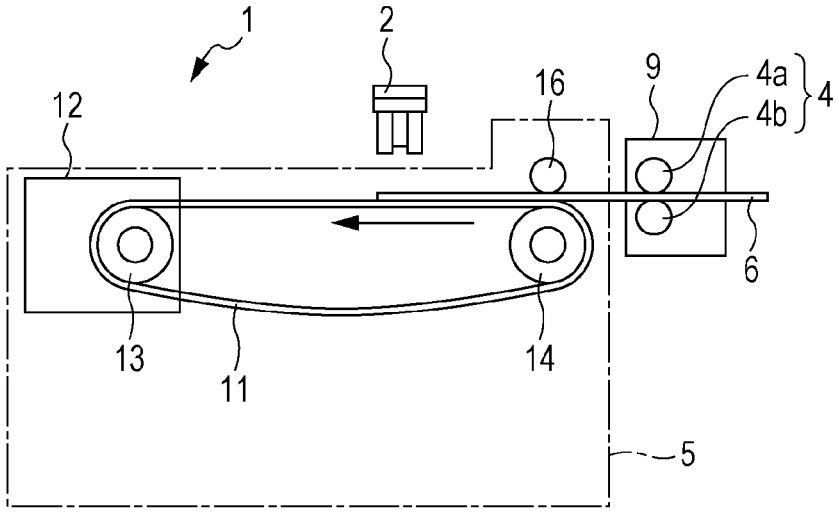

FIGS. 1A and 1B are schematic views each describing the internal configuration of a printer 1. FIG. 1A is a plan view and FIG. 1B is a side view. For example, the printer 1 includes a head module 2 which is elongated along the width direction (a direction substantially orthogonal to the transport direction of a recording sheet) of a recording sheet 6 such as a roll sheet (a type of a recording medium or a shooting object), a sheet feeding roller 4 which supplies the recording sheet 6 to a transport belt 11, a sheet feeding motor 9 for driving the sheet feeding roller 4, a transport mechanism 5 which transports the recording sheet 6 using the transport belt 11, an ink cartridge 10 (a type of a liquid supply source) which stores an ink. The printer 1 according to the embodiment is a so-called line head type ink jet recording device which performs only the transport of the recording sheet 6 during a recording operation without accompanying the scanning of a head module 2 in the width direction of the recording sheet 6. The ink cartridge 10 and a sub-tank 27 of the head module 2 to be described later are connected to each other, for example, using a supply tube 19 made from a flexible member such as a silicon resin and the like. The ink stored in the ink cartridge 10 is pressurized and transported to the head module 2 side through a supply tube 19 using a pump not illustrated.

The sheet feeding roller 4 is located upstream of the transport mechanism 5, and is configured to have a pair of upper and lower rollers 4*a* and 4*b* which may be synchronously rotatable in opposite directions with the recording sheet 6 fed from a sheet feeding unit not illustrated pinched. The sheet feeding roller 4 is driven by power from the sheet feeding motor 9 and is configured to supply the recording sheet 6 to the transport mechanism 5 side. The transport mechanism 5 is configured to have a transport motor 12 which is a drive source of the transport belt 11, a drive roller 13 to which the power is delivered from the transport motor 12, a driven roller 14 located further upstream side than the drive roller 13, the transport belt 11 in an endless shape stretched between the drive roller 13 and the driven roller 14, and a pressure roller 16 which presses the recording sheet 6 against the transport belt 11 side. The pressure roller 16 is located right on the driven roller 14 with the transport belt 11 pinched and is provided to contact the transport belt 11.

Figure 2:
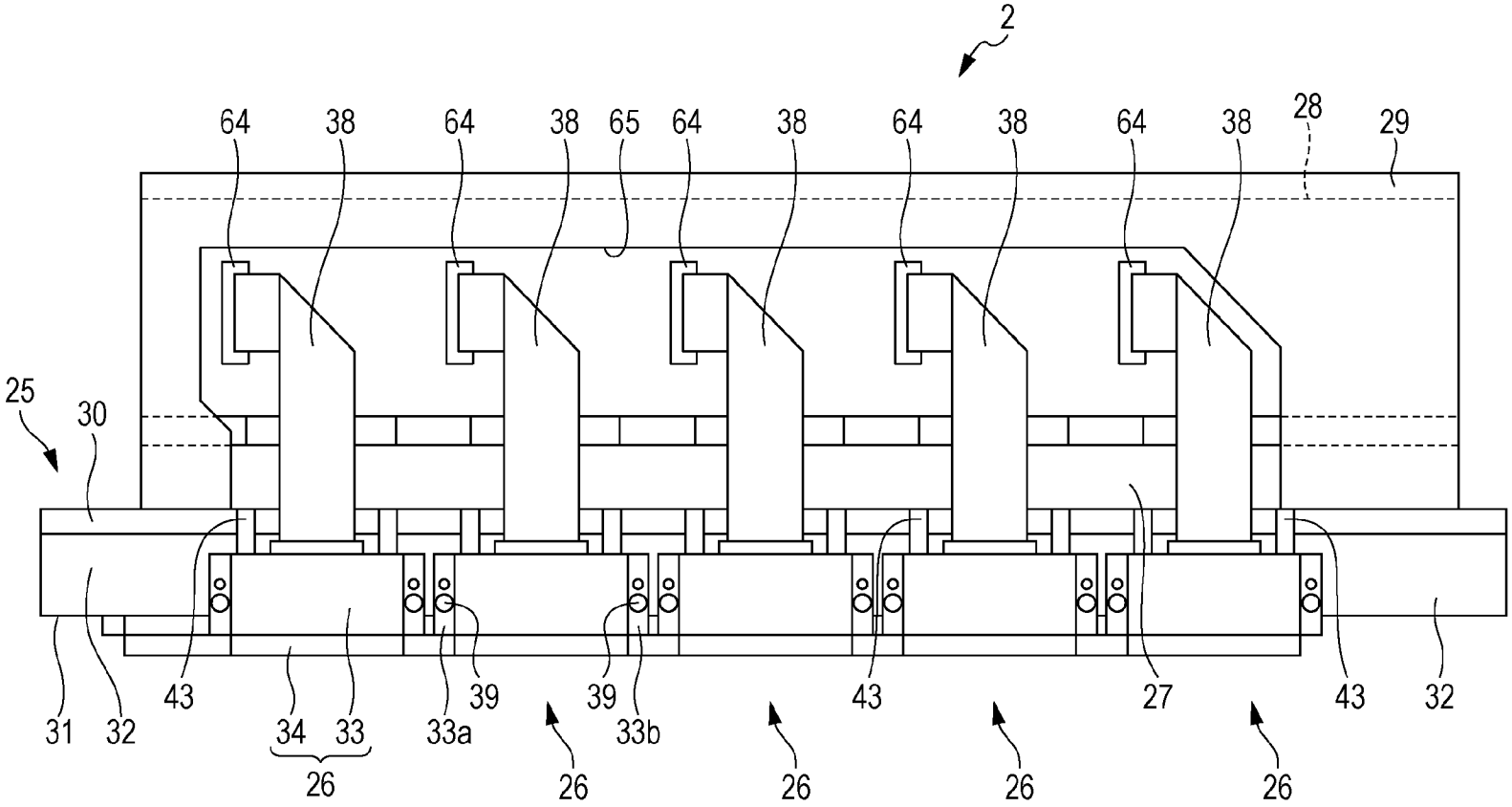
FIG. 2 is a front view of a head module.
Figure 3:
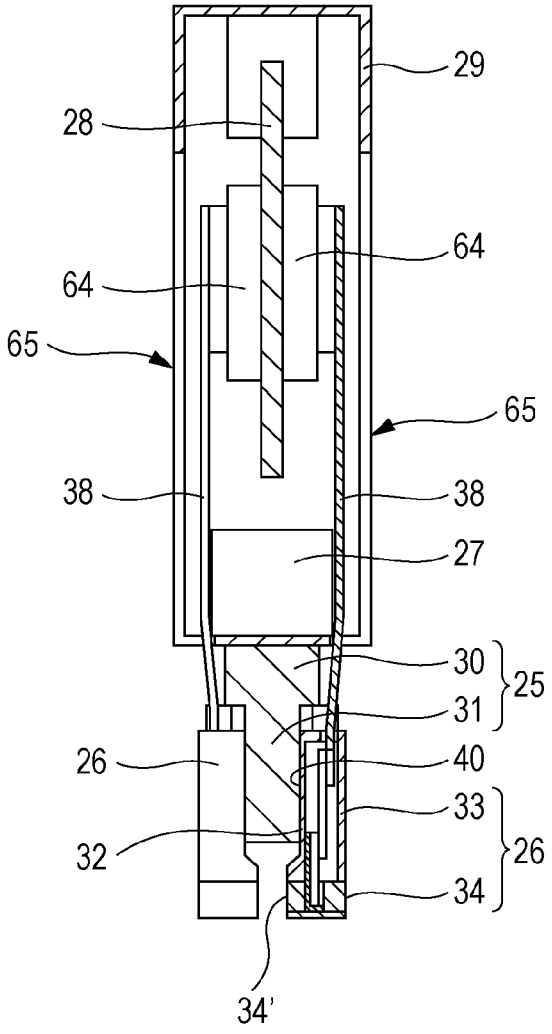
FIG. 3 is a cross-sectional view of the head module in a transverse direction.
Figure 4:
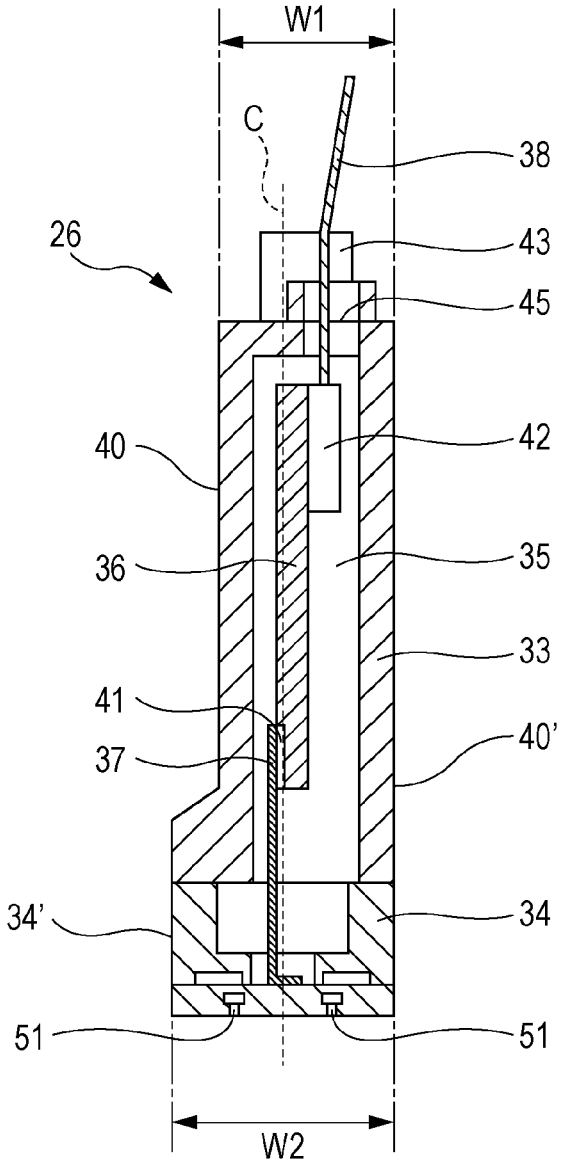
FIG. 4 is a cross-sectional view of a unit head.

FIG. 2 is a front view which describes a configuration of the head module 2 in the embodiment. In addition, FIG. 3 is a cross-sectional view of the head module 2 in a short direction.

The head module 2 in the embodiment is configured to have a plurality of unit heads 26, a sub-tank 27 common to each unit head 26, and a drive substrate 28 common to each unit head 26 mounted on, for example, a metal frame 25 such as stainless steel and the like. The frame 25 has a shape that an elongated base frame 30 in a direction intersecting (orthogonal) with the transport direction of the recording sheet 6 is combined with a fixation frame 31 protruding downward from the lower surface of the base frame 30 (the recording sheet 6 side or an ink ejection side during a recording operation) in a T-shape in a side view. Therefore, the front and the back surfaces (one side surface and the other side surface) of the fixation frame 31 are perpendicular to the upper and the lower surfaces of the base frame 30. The front and the back surfaces of the fixation frame 31 are the fixation surfaces 32 on which the unit head 26 is mounted. Then, with the front side of the fixation surface 32 facing upstream side in the transport direction of the recording sheet 6 and the back side of the fixation surface 32 facing downstream side in the transport direction of the recording sheet 6, a head module 2 is located in the printer 1.

On the front and the back fixation surfaces 32 of the fixation frame 31, a plurality of unit heads 26 are mounted respectively along the longitudinal direction of the frame 25. In the embodiment, respective five unit heads 26, in total of 10 heads, are fixed to the front and the back fixation surfaces 32 of the fixation frame 31 via screw. The unit head 26 on the front fixation surface and the unit heads 26 on the back fixation surface are disposed so as to be away from each other in the longitudinal direction of the frame.

The unit head 26 is configured to have a substrate case 33 (corresponding to a second portion in the invention) and a head main body 34 (corresponding to a first portion in the invention). The substrate case 33 is a hollow box-shaped member where a case flow path (not illustrated) to which an ink is introduced from the sub-tank 27 side and an accommodation space portion 35 in which a relay substrate 36 to be described later is accommodated are formed therein. On both sides of the substrate case 33, flange portions 33*a* and 33*b* which are thinner than the substrate case 33 are provided, respectively (refer to FIG. 2). On the flange portions 33*a* and 33*b*, corresponding to a fastening hole provided on a head fixed portion (fixation surface 32) of the fixation frame 31, an insertion hole 39 in which a fastening member such as a screw is inserted is provided. One surface of the front and the back side surfaces of the substrate case 33 functions as a fastening surface 40 (corresponding to a contact portion in the invention) which is fastened in contact with the fixation surface 32. When the fastening surface 40 is screwed into the fixation surface 32 of the fixation frame 31, the fastening surface 40 is configured so that a fixed position of the unit head 26 in the frame 25 is defined. A configuration can be adopted in which only the flange portions 33*a* and 33*b* are in contact with the fixation surface 32 of the fixation frame 31, and the other portions are not in contact with the fixation surface 32 (spaced apart). In the configuration, the flange portions 33*a* and 33*b* function as a contact portion in the invention. In short, a portion in contact with the frame 25 to define a position (in particular, a position of a direction overlapping the frame 25 (the thickness direction of the frame 25)) of the frame 25 when fixing the frame 25 is corresponding to a contact portion. Therefore, a portion (for example, a portion in contact with the frame 25 to receive an ink) in contact with the frame 25 for purposes other than performing a function of positioning is not included as the contact portion in the invention.

The thickness of the substrate case 33, that is, the size W1 in a direction overlapping the fixation surface 32 of the fixation frame 31 is shorter than the size W2 of the head main body 34 in the same direction. Then, the fastening surface 40 of the substrate case 33 is formed at a position closer to a side surface 40' opposite to the fixation surface 32 side of the fixation frame 31 than a side surface 34' of the head main body 34 on the fixation frame 31 side. Accordingly, a portion (at least the head main body 34) of the unit head 26 lower than the fastening surface 40 further protrudes to the fixation frame 31 side than the fastening surface 40. Therefore, the relay substrate 36 which is accommodated in the substrate case 33 is located at a position closer to the side surface 40' opposite to the fixation surface 32 side of the fixation frame 31 than the center line C in the width direction of the head main body 34.

The relay substrate 36 is a substrate which performs a relay between a first cable 37 connected to a piezoelectric element 46 of the head main body 34 and a second cable 38 from the drive substrate 28 side. The first cable 37, the relay substrate 36, and the second cable 38 configure a wiring member in the invention. In the relay substrate 36, a substrate terminal portion 41 electrically connected to the other end side terminal (not illustrated) of the first cable 37, a connector 42 (corresponding to a connection portion in the invention) connected to the second cable 38, other circuit patterns and the like thereof are formed. In the embodiment, a substrate terminal portion and the connector 42 are provided on surfaces opposite to each other. Then, in a state that a surface where the substrate terminal portion 41 is provided is the fastening surface 40 side and a surface where the connector 42 is provided is an opposite side to the fastening surface 40, the substrate terminal portion 41 and the connector 42 are accommodated in the accommodation space portion 35. Therefore, the connector 42 of the relay substrate 36 is located at a position still closer to the side surface 40' opposite to the fixation surface 32 side of the fixation frame 31 than the relay substrate 36. The substrate terminal portion may be configured to be formed on the same surface side as the connector 42.

On the upper surface (a surface opposite to the nozzle surface of the head main body 34) of the substrate case 33, introduction portions 43 in a cylindrical shape where an ink is introduced from the sub-tank 27 side are erectly provided on both sides in a nozzle arrangement direction, respectively. The introduction portions 43 are connected to an outlet portion which is provided in the sub-tank 27 mounted on a base frame 30 and is not illustrated. An ink introduced to the introduction portions 43 is supplied to the reservoir side of the head main body 34 through a case flow path formed in the substrate case 33. In addition, on the upper surface of the substrate case 33, between two introduction portions 43, a wiring opening 45 is provided through which the second cable 38 connected to the connector 42 in the accommodation space portion 35 is drawn out. The wiring opening 45, corresponding to a position of the connector 42, is formed at a position close to the side surface 40' of the opposite side to the fastening surface 40 side.

Figure 5:
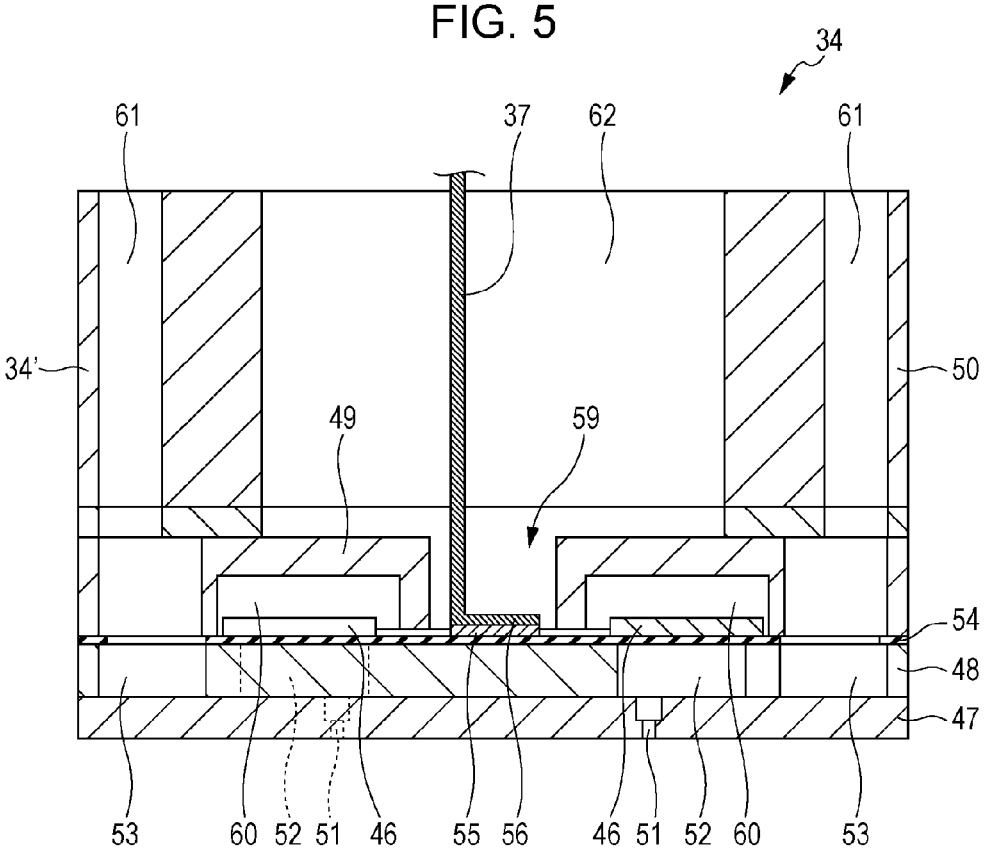
FIG. 5 is a cross-sectional view of the main portion of a head main body.

FIG. 5 is a cross-sectional view of a main portion illustrating an internal configuration of the head main body 34 (head chip) in the embodiment.

The head main body 34 in the embodiment is schematically configured to have a nozzle plate 47, a flow path substrate 48, a piezoelectric element 46, a protection substrate 49, and the like, and is mounted onto a case 50 where these members are stacked.

The nozzle plate 47 (a type of a nozzle forming member) is a member in a plate shape where a plurality of nozzles 51 are opened in a row along the width direction of the recording sheet 6 at a pitch corresponding to a dot formation density in the same direction. In the embodiment, two nozzle rows (a type of nozzle group) configured to have the plurality of nozzles 51 provided side by side are arranged in a direction corresponding to a recording sheet transport direction of the nozzle plate 47. Then, a side surface to which an ink of the nozzle plate 47 is ejected becomes a nozzle surface in the invention.

On the flow path substrate 48, a plurality of pressure chambers 52 partitioned by a plurality of partition walls using an anisotropic etching process are formed corresponding to each nozzle 51. On the outside of the row of the pressure chamber 52 on the flow path substrate 48, a common liquid chamber 53 partitioning a portion of the common liquid chamber 53 is formed. The common liquid chamber 53 communicates with each pressure chamber 52. The piezoelectric element 46 (a type of the pressure generator) is formed on the upper surface of an opposite side to the nozzle plate 47 side of the flow path substrate 48 through an elastic film 54. The piezoelectric element 46 is formed by sequentially stacking a lower electrode film made of metal, a piezoelectric layer made of, for example, lead zirconate titanate or the like, and an upper electrode film made of metal (none illustrated). The piezoelectric element 46 is a so-called piezoelectric element in a flexural mode, and is formed so as to cover the top of the pressure chamber 52. In the embodiment, two piezoelectric element rows corresponding to two nozzle rows are provided side by side in a direction orthogonal to a nozzle row in a state where the piezoelectric elements 46 are away from each other as viewed in a nozzle row direction. From each piezoelectric element 46, an electrode terminal 55 is extended to the center region between the piezoelectric element rows, respectively.

On the flow path substrate 48 where the piezoelectric element 46 is formed, the protection substrate 49 having a wiring hollow portion 59 penetrated in the thickness direction is disposed. In a plan view, an electrode terminal 55 of the piezoelectric element 46 is disposed in the wiring hollow portion 59 of the protection substrate 49. An end portion of the first cable 37 is inserted into the wiring hollow portion 59, and an end side wiring terminal 56 formed on the one end portion is electrically connected to the electrode terminal 55 of the piezoelectric element 46. Then, each piezoelectric element 46 is configured so as to be deformed by applying a drive voltage through the first cable 37. In addition, on the protection substrate 49, a relief hollow portion 60 in a size not to impede the drive of the piezoelectric element 46 is formed in a region facing the piezoelectric element 46.

In a case 50, an ink introduction path 61 for supplying an ink introduced from the sub-tank 27 side to the common liquid chamber 53 side by communicating with a case flow path (not illustrated) of the substrate case 33 is formed, and a hollow portion 62 penetrated in the width direction is provided at the center portion thereof. Then, the other end side of the first cable 37 whose one end side wiring terminal 56 is connected to the electrode terminal 55 is drawn into the accommodation space portion 35 of the substrate case 33 through the wiring hollow portion 59 and the hollow portion 62 of the case 50, and the other side wiring terminal is electrically connected to the substrate terminal portion 41 of the relay substrate 36. The first cable 37 and the second cable 38 are made of a flexible cable. More specifically, a conductive pattern of a copper coil and the like is formed on the surface of the base film having flexibility such as polyimide and the like, and a conductive pattern other than the wiring terminal of both sides is configured to be covered by resist.

The unit head 26 configured as described above introduces an ink from the sub-tank 27 into the common liquid chamber 53 side through the introduction portions 43, a case flow path, and an ink introduction path 61, and fills an ink flow path (a type of liquid flow path) leading to the nozzle 51 through a pressure chamber 52 from the common liquid chamber 53 with an ink. Then, a drive signal from the drive substrate 28 side is applied to the piezoelectric element 46 through a wiring member such as the first cable 37 and the like and the piezoelectric element 46 is flexurally deformed. Accordingly, there is created a change in the pressure of an ink in a corresponding pressure chamber 52, an ink is ejected from a nozzle 51 by the change in the pressure of an ink.

Here, when the unit head 26 is fixed in a state where the fastening surface 40 of the substrate case 33 is positioned in contact with the fixation surface 32 of the fixation frame 31 in the frame 25, the head main body 34 is positioned lower than the lower end surface (the end surface of a nozzle surface side of the unit head 26) of the fixation frame 31. In addition, the fastening surface 40 is offset further to the side surface 40' of an opposite side to the fixation frame 31 than to the side surface 34' of the fastening surface 40 side of the head main body 34, so that a portion of the head main body 34 protrudes towards further the fixation frame 31 side (an opposite surface side of the fixation frame 31) than the fastening surface 40. That is, in the embodiment, the head main body 34 is disposed closer to the fixation frame 31 side than to the fastening surface 40 due to a difference between W2 and W1. Therefore, nozzles of the unit heads 26 which are fixed to the fixation surface 32 of both sides of the fixation frame 31 come close to each other. By this configuration, without changing the thickness of the fixation frame 31 in the frame 25 and the size of the head main body 34, it is possible to suppress the size of the entire head module 2 in the thickness direction (a contact direction of the fastening surface 40 of the unit head 26 with the fixation surface 32 of the fixation frame 31). Therefore, it is possible to make the head module 2 small without reducing the rigidity of the frame 25.

The drive substrate 28 is a substrate which receives a control signal such as a drive signal and the like sent from a control unit side of the printer 1, which is not illustrated, and distributes the received control signal to each unit head 26 through the second cable 38. On both sides of the drive substrate 28, a plurality of connectors 64 corresponding to each unit head 26 are provided. The other end portion of the second cable 38 whose one end portion is connected to the connector 42 of the relay substrate 36 of the unit head 26 is connected to the connector 64. The drive substrate 28 is supported by the support frame 29 in a standing posture with respect to the base frame 30 of the frame 25, and is fixed to the upper surface side (an opposite side to the nozzle surface of the unit head 26) of the base frame 30 through the support frame 29. The support frame 29 is a member which is formed in a substantially rectangular cylindrical shape in a side view by a thin metal plate. In the internal space of the support frame 29, the sub-tank 27 and the like besides the drive substrate 28 are accommodated. In addition, at a position facing the connector 64 of the drive substrate 28, an opening 65 which exposes these connectors 64 is provided.

In the embodiment, the relay substrate 36 is located at a position closer to the side surface 40' of the opposite side to the fixation surface 32 side (fastening surface 40 side) of the fixation frame 31 than the center line C of the head main body 34 in the width direction, and the connector 42 is located at a position closer to the side surface 40' than the relay substrate 36, so that the first cable 37, the relay substrate 36, and the second cable 38 are located so as to get close to the side surface 40' of the substrate case 33 by stages in this order. Therefore, it is possible to draw a wiring member to an opposite side to a nozzle surface through the wiring opening 45 from a position close to the side surface 40' opposite to the fastening surface 40 without forcedly bending the wiring member from a joining position to the electrode terminal 55 of the piezoelectric element 46. Then, the other end side of the second cable 38 outside from the wiring opening 45 is extended to the drive substrate 28 located on the base frame 30 in the frame 25 in a substantially straight state without being significantly largely bent. Then, in the embodiment, the other end portion of the second cable 38 is folded at a fold line with a slope of about 45 in the longitudinal direction of the cable, and the other end portion of the wiring terminal portion is electrically connected to a corresponding connector 64 of the drive substrate 28. Thus, routing the wiring member from a fixed position of the unit head 26 to the drive substrate 28 positioned at an opposite side to the fixed position on the frame 25 becomes easy, so that the efficiency of the wiring operation is improved. In addition, it is possible to shorten the entire length of the wiring member as much as the folding can be reduced, and this can contribute to cost reduction.

The embodiment illustrates an example in which the first portion (head main body 34) and the second portion (substrate case 33) are configured to have a different member, but the embodiment is not limited thereto. The embodiment may be configured to include a portion corresponding to the first portion and a portion corresponding to the second portion in the same member (a member integrally formed).

In addition, the invention is not limited to the embodiment described above. Additionally, the embodiment illustrates the head module 2 mounted on the ink jet printer, but if a head module with this configuration is adopted, the embodiment can be applied to those ejecting a liquid other than an ink. For example, the invention can be applied to a color material ejecting head used in manufacturing a color filter for a liquid crystal display and the like, an electrode material ejecting head used in forming an electrode for an organic Electro Luminescence (EL) display, a Field Emission Display (FED), and the like, and a bio-organic material ejecting head used in manufacturing a biochip (biological and chemical element) and the like.

What is claimed is:

1. A liquid ejecting head module comprising:

a plurality of unit heads, where each unit head has a nozzle surface where a nozzle for ejecting a liquid is formed, a liquid flow path communicating with the nozzle, and a pressure generator creating a change in the pressure of the liquid in the liquid flow path, and ejects the liquid in the liquid flow path from the nozzle by driving the pressure generator;

a fixation member in which each unit head is fixed to one fixation surface and the other fixation surface, respectively;

a drive substrate which is located on a side of the fixation member opposite to a nozzle surface side of each unit head; and a plurality of wiring members which individually electrically connect the pressure generator of each unit head with the drive substrate, wherein each unit head has a first portion having the nozzle surface, and a second portion which is positioned on an opposite side to the nozzle surface of the first portion, has a contact portion which is in contact with the fixation member when fixed, and accommodates a portion of one of the plurality of wiring members, the contact portion of the second portion is formed at a position closer to a surface of an opposite side to a fixation member side than a side surface of the first portion on the fixation member side, the first portion is positioned further on a liquid ejecting side than the fixation member with the contact portion of the second portion fixed to the fixation member, and each wiring member whose one end portion is connected to the pressure generator is drawn through the second member, from a position close to a surface of the opposite side to the contact portion of the second member to an opposite side to the nozzle surface, and the other end portion of each wiring member is connected to the drive substrate.

2. The liquid ejecting head module according to claim 1, wherein each wiring member includes a first wiring member whose one end side is connected to the pressure generator, a second wiring member whose the other end side is connected to the drive substrate, and a relay substrate relaying between the second wiring member and the first wiring member, the relay substrate has a substrate terminal portion to which the other end side of the first wiring member is connected and a connection portion to which the one end side of the second wiring member is connected, and is accommodated in the second portion, and at least the connection portion is disposed on a surface of a side of the relay substrate opposite to a fixation side with respect to the fixation member.

3. A liquid ejecting apparatus comprising the liquid ejecting head module according to claim 2.

4. A liquid ejecting apparatus comprising the liquid ejecting head module according to claim 1.

5. A liquid ejecting head module comprising:

a plurality of unit heads, where each unit head has a nozzle surface where a nozzle for ejecting a liquid is formed, a liquid flow path communicating with the nozzle, and a pressure generator creating a change in the pressure of the liquid in the liquid flow path, and ejects the liquid in the liquid flow path from the nozzle by driving the pressure generator;

a fixation member in which each unit head is fixed to one fixation surface and the other fixation surface, respectively;

a drive substrate which is located on a side of the fixation member opposite to a nozzle surface side of each unit head and is common to each unit head; and a wiring member which electrically connects the pressure generator of each unit head with the drive substrate, wherein each unit head has a first portion having the nozzle surface, and a second portion which is positioned on an opposite side to the nozzle surface of the first portion, has a contact portion which is in contact with the fixation member when fixed, and accommodates a portion of the wiring member, the contact portion of the second portion is formed at a position closer to a surface of an opposite side to a fixation member side than a side surface of the first portion on the fixation member side, the first portion is positioned further on a liquid ejecting side than the fixation member with the contact portion of the second portion fixed to the fixation member, and the wiring member whose one end portion is connected to the pressure generator is drawn through the second member, from a position close to a surface of the opposite side to the contact portion of the second member to an opposite side to the nozzle surface, and the other end portion of the wiring member is connected to the drive substrate.

6. The liquid ejecting head module according to claim 5, wherein the wiring member includes a first wiring member whose one end side is connected to the pressure generator, a second wiring member whose the other end side is connected to the drive substrate, and a relay substrate relaying between the second wiring member and the first wiring member, the relay substrate has a substrate terminal portion to which the other end side of the first wiring member is connected and a connection portion to which the one end side of the second wiring member is connected, and is accommodated in the second portion, and at least the connection portion is disposed on a surface of a side of the relay substrate opposite to a fixation side with respect to the fixation member.

7. A liquid ejecting apparatus comprising the liquid ejecting head module according to claim 5.

8. A liquid ejecting apparatus comprising the liquid ejecting head module according to claim 7.

* * * * *